United States Patent [19]

Sasaki et al.

[11] 4,265,082

[45] May 5, 1981

[54] SPUN-LIKE YARN AND A PROCESS FOR MANUFACTURING THE SAME

[75] Inventors: Yoshiyuki Sasaki, Takatsuki; Katsuyuki Kasaoka, Ibaraki, both of Japan

[73] Assignee: Teijin Limited, Osaka, Japan

[21] Appl. No.: 82,722

[22] Filed: Oct. 9, 1979

[30] Foreign Application Priority Data

Oct. 20, 1978 [JP] Japan ..... 53-128559

[51] Int. Cl.[3] ..... D02G 3/34

[52] U.S. Cl. ..... 57/207; 57/6; 57/328; 57/210

[58] Field of Search ..... 57/206, 207, 210, 224, 57/226, 227, 252, 253, 3, 5, 6, 315, 328

[56] References Cited

U.S. PATENT DOCUMENTS

| | | | |
|---|---|---|---|
| 3,079,746 | 3/1963 | Field | 57/328 |
| 3,116,588 | 1/1964 | Breen et al. | 57/328 X |
| 3,279,164 | 10/1966 | Breen et al. | 57/207 X |
| 3,365,872 | 1/1968 | Field | 57/224 |
| 3,367,095 | 2/1968 | Field | 57/328 X |
| 3,732,684 | 5/1973 | Csok et al. | 57/207 |
| 4,003,194 | 1/1977 | Yamagata | 57/328 |

*Primary Examiner*—Donald Watkins

*Attorney, Agent, or Firm*—Burgess, Ryan and Wayne

[57] ABSTRACT

After a polyester tow having a total denier of 5000 de is drafted at a ratio of between 10 and 20 and stretch broken, the obtained fiber bundle of staple fibers is subjected to a false twisting operation by means of a fluid jet nozzle, and then the false twisted fiber bundle is wound several turns around a hot roller heated at a temperature of 220° C. and located in a detwisting region downstream from the false twisting nozzle. The surface fibers, which extend outwards because of the centrifugal force generated by the rotation of the fiber bundle during the detwisting thereof, suddenly stopped rotation when the fiber bundle contacts the hot roller, and the surface fibers wrap around the body portion of the fiber bundle to form a plurality of individual wrapping portions, in each of which the surface fibers are interlaced each other. Thus a spun-like yarn is obtained.

8 Claims, 17 Drawing Figures

SPUN-LIKE YARN AND A PROCESS FOR MANUFACTURING THE SAME

BRIEF DESCRIPTION OF THE INVENTION

The present invention relates to a spun-like yarn. More specifically, the present invention relates to a spun-like yarn comprising: a fiber bundle which essentially comprises staple fibers and which substantially has no true twist therein along the yarn; and surface fibers of thermoplastic synthetic staple fibers which wrap around the fiber bundle so that the fiber bundle is cohered.

BACKGROUND OF THE INVENTION

Various spun-like yarns comprising a fiber bundle having substantially no true twist therein have conventionally been proposed. For example, Japanese Patent Publication No. 28250/68 (corresponding to U.S. Pat. No. 3,079,746) discloses a spun-like yarn comprising a core of discontinuous fibers formed in a rigid bundle encased by a surface of discontinuous fibers, the core having substantially no true twists therein, and the surface fibers having random helical shapes having various helical angles in a range between 10° and 80° and being wrapped around the core by means of true twists thereof, whereby the wrapping fibers randomly along the core form a substantial continuous connection. Furthermore, Japanese Patent Laid-open No. 89650/75 discloses a wrapped spun-like yarn wherein, over the surface of a bundle of staple fibers, which bundle is substantially untwisted, a few staple fibers wrap around the bundle forming a predetermined wrapping angle.

However, these spun-like yarns suffer from disadvantages: that the wrapping of the surface fibers becomes loose if the diameter of the yarn is large, and therefore, the cohesion of the core fiber bundle by means of the surface fibers becomes unsatisfactory; that a sufficient strength of the yarn cannot be obtained when the count of the yarn is low or when the fineness of the fibers composing the yarn is large; and that, in some cases, a stable yarn shape cannot be obtained stably because the cohesion is insufficient.

In addition, in the conventional spun-like yarn, the surface fibers continuously wrap around the core fiber bundle, and, if a portion of the wrapping of the surface fibers is broken, the whole wrapping of the surface fibers may loosen, and accordingly, the core fiber bundle loses its cohesion, and then, there causes another disadvantage in that the spun-like yarn is broken.

SUMMARY OF THE INVENTION

An object of the present invention is to provide a novel spun-like yarn which is free from the above-mentioned disadvantages which are unavoidable in the conventionally known spun-like yarn.

Another object of the present invention is to provide a spun-like yarn including a fiber bundle which substantially has no true twist therein, and the spun-like yarn has a high cohesion and a high strength as well a high strength efficiency.

A further object of the present invention is to provide a process for manufacturing the spun-like yarn of the invention.

According to the present invention, a spun-like yarn is provided which comprises a fiber bundle essentially comprising staple fibers and substantially having no true twist therein and surface fibers of thermoplastic synthetic staple fibers wrapped around the fiber bundle to result in cohesion in the fiber bundle. The surface fibers form a plurality of individual wrapping portions spaced along the yarn, each of the wrapping portions being wrapped securely around the fiber bundle in a direction substantially perpendicular to the fiber bundle, and in each of the wrapping portions of the surface fibers are interlaced with each other. The number of the wrapping portions is at least two per the length of one centimeter of the yarn, and the fiber packing density of the yarn is in a range between two $cm^3/g$ and eight $cm^3/g$.

The process of the present invention comprises:

a step of delivering a fiber bundle essentially comprising thermoplastic synthetic staple fibers;

a step of imparting false twists to the delivered fiber bundle in a false twisting region; and a step wherein, just after the fiber bundle is false twisted, the false twisted fiber bundle is detwisted, and then, the fiber bundle in a detwisting region located downstream from the false twisted region is heated while the fiber bundle is being delivered and the rotational movement of surface fibers generated by the detwisting is prevented, so that the surface fibers of the fiber bundle are wrapped around the body portion of the fiber bundle in a direction perpendicular to the lengthwise direction of the fiber bundle, and so that they are heat set.

BRIEF DESCRIPTION OF THE DRAWINGS

The present invention will now be explained in detail with reference to the attached drawings, wherein.

DETAILED DESCRIPTION OF THE INVENTION

Figure 1:
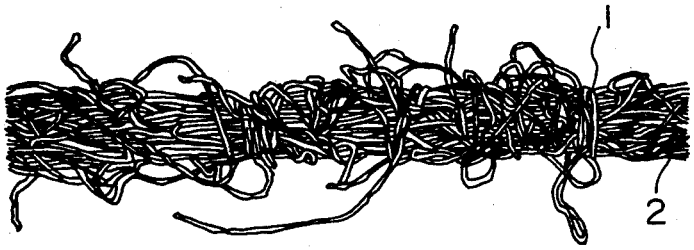
FIG. 1 is an explanatory view of a spun-like yarn according to the present invention.

A spun-like yarn of the present invention comprises: a fiber bundle essentially comprising staple fibers and substantially having no true twist therein; and surface fibers of thermoplastic synthetic fibers wrapping around the fiber bundle so as to cohere with the fiber bundle. The term "a fiber bundle substantially having no true twist therein" means a fiber bundle composed of parallel fibers, each of which have no twists, or a fiber bundle composed of fibers which have alternating twists, i.e., S and Z twists, along the length thereof and as a total they do not have any true twists therein when a predetermined length of the yarn is observed, because the alternating twists eliminate each other. The term "a fiber bundle essentially comprising staple fibers" means that the fiber bundle is essentially made of thermoplastic synthetic staple fibers, such as polyester, polyamide, polyacrylics or polypropylene, or mixture thereof. The fiber bundle may include some continuous filaments, if desired, in accordance with the purpose of the end use of the spun-like yarn, as long as the spun-like yarn has a hand as an actual spun yarn.

However, since the surface fibers in the spun-like yarn of the present invention are required to be of thermoplastic synthetic staple fibers, it is desirable that the fiber bundle is also essentially made of thermoplastic synthetic fibers, especially polyester fibers which have a good fiber quality and a good ability to be heat set when in the subsequent process the yarn is subjected to a treatment, such as dyeing and weaving.

The surface fibers constituting the spun-like yarn of the present invention are made of thermoplastic staple fibers, so that each one end of the surface fibers is capable of free movement. The thermoplastic synthetic fibers may be any kind of fibers which are thermoplastic, for example, polyester, polyamide, polyacrylics or polypropylene. It is not limited to but preferably that, the average fiber length of the staple fibers constituting the fiber bundle and the surface fibers of the present invention be equal to or more than 200 mm for a thick yarn having a yarn count of less than 30, so that the cohesive effect of the yarn is increased.

In a spun-like yarn of the present invention, the surface fibers form a plurality of individual wrapping portions spaced along the yarn, each of the wrapping portions being securely wrapped around the fiber bundle in a direction substantially perpendicular to the fiber bundle, and in each of the wrapping portions the surface fibers being interlaced with each other, and the number of the wrapping portions being at least 2 per length of 1 cm of the yarn. To obtain such spun-like yarn, for example, the following process can be utilized.

The fiber bundle, essentially comprising thermoplastic staple fibers, is subject to a false twisting operation by means of a false twisting means located downstream from the feed roller. The false twisting means may be a fluid jet nozzle which is conventionally known. Downstream from the false twisting means, since the fiber bundle to which has been imparted false twists is detwisted, no twists substantially remain and a fiber bundle having no substantial true twists is obtained. However, after the actual twisting and detwisting operation, because of the fluctuation in the number of the twists and the resultant movement of the detwisting region and the change in the number of the detwisted twists, the obtained fiber bundle may have alternating twists of S and Z twists along a part of or entire length of the yarn.

As mentioned above, the surface fibers of the fiber bundle are composed of staple fibers, and each end of the surface fiber is capable of free movement. As a result, the other ends of the staple fibers of the surface fibers are fuzzing before the fiber bundle is subjected to the false twisting operation, and after the fiber bundle is subjected to the false twisting operation and detwisting operations, the other ends extend outwards like cut piles because of the centrifugal force generated by the rotation of the fiber bundle. When the running fiber bundle, whose surface fibers are extending outwards, is in contact with a heater located at a portion in the detwisting region disposed downstream from the false twisting region, the staple fibers which are in the surface region of the fiber bundle and which have been extended outwards like cut piles wrap around the fiber bundle. Since the fiber bundle has been rotated at a speed of several hundred thousand rpm, the ends of the staple fibers can wrap around the fiber bundle in a direction substantially perpendicular to the fiber bundle simultaneously while the bundle is in contact with the heater, even if the delivering speed of the fiber bundle is high. It should be noted that upon wrapping, the running fiber bundle comes in contact with the heater located in the detwisting region downstream from the false twisting means and that the staple fibers located at the surface of the fiber bundle, which fibers are extending outwards like cut piles, wrap around the fiber bundle and simultaneously they are heat set by the heater maintained at a high temperature, and that as a result, the surface fibers wrap securely around the fiber bundle. It also should be noted that if the heater is located in the front of the false twisting nozzle the above wrapping effect cannot be obtained. Upon the wrapping of the surface fibers, staple fibers extending outwards from the surface of the fiber bundle are interlaced together, especially long staple fibers which are the center of the interlacing, so that wrapping portions are formed. As a result, as illustrated in FIG. 1, a spun-like yarn according to the present invention comprises wrapping portions 1 which result from the wrapping of the surface fibers and a fiber bundle or core fiber bundle 2 which substantially has no twist therein. Note that FIG. 1 is an explanatory view of the spun yarn of the present invention. It is necessary that the wrapping portions be distributed at a ratio of at least two per one centimeter. The individual wrapping portions are independent from each other. When the number of the wrapping portions is less than 2/cm, it is difficult to obtain a spun-like yarn which can be comparable with that of the present invention because the distance between the adjacent wrapping portions is too large to obtain a yarn having sufficient strength, and the fiber packing density thereof will not be in a range between 2 $cm^3/g$ and 8 $cm^3/g$. The number of the wrapping portions per one centimeter is varied in accordance with changes in the temperature of the heater, more specifically, as the temperature increases, there is a tendency that the number increases.

Figure 2:
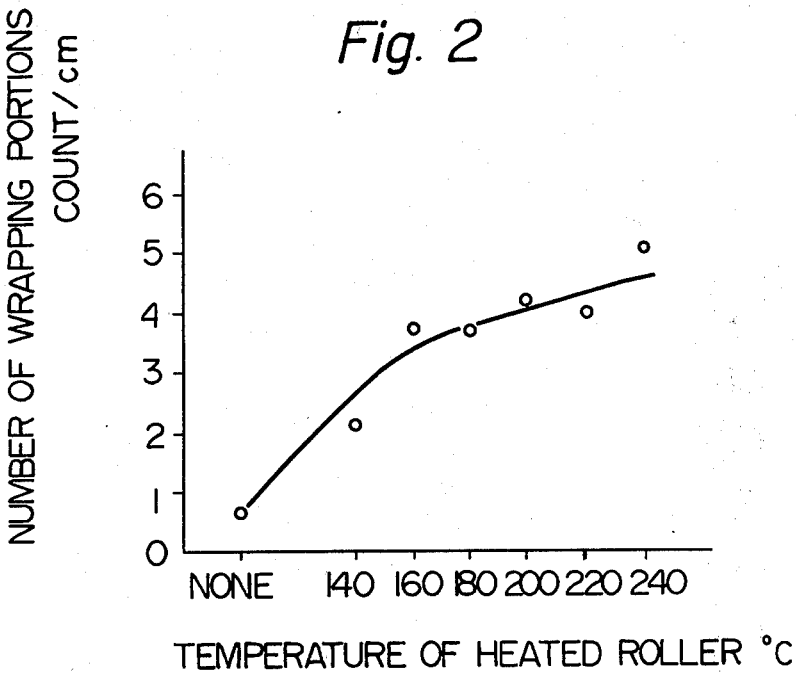
FIG. 2 is a diagram wherein the relationship between the heated temperature and the number of the wrapping portions in a spun-like yarn of polyester according to the present invention is represented.

FIG. 2 is a diagram wherein the relationship is shown between the heated temperature of a heated roller, i.e. a kind of heater, and the number of the wrapping portions in a spun-like yarn of a polyester. From FIG. 2 it is preferable, for a yarn of polyester, that the temperature of the heater is equal to or more than 160° C. to create wrapping portions at a ratio equal to or more than 2/cm. However, if the temperature is too high, the fibers may be degraded, and therefore, it is preferable that the temperature be not more than 250° C.

As to the construction of the heater, there is no limitation if the running fiber bundle can be in contact with the heater. However, if the heater is a rotatable heated roller, the peripheral speed of which is substantially the same as the delivering speed of the fiber bundle, the rotational movement of the fiber bundle caused by the detwisting of the same is prevented on the surface of the roller while the delivering movement of the fiber bundle is not prevented, and as a result, the ends of the staple fibers located at the surface region of the fiber bundle wrap around the fiber bundle in a short time and are heat set, so that the wrapping is securely set.

Figure 3:
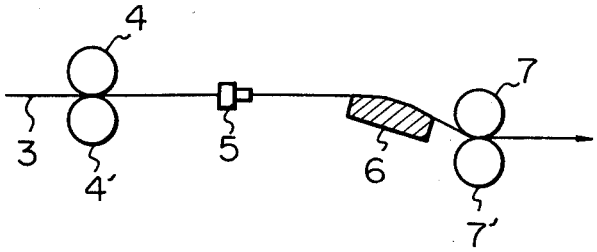
FIGS. 3 and 4A are diagrammatical views of different steps wherein a spun-like yarn of the present invention is produced.
Figure 4A:
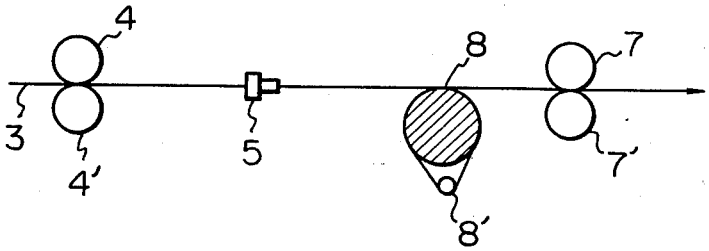

FIGS. 3 and 4A are diagrammatical views wherein a spun yarn of the present invention is produced. In FIG. 3, a heater of a fixed type is used with which the fiber bundle is in contact, and in FIG. 4A, instead of the fixed type heater in FIG. 3, a rotatable heated roller is used.

In FIG. 3, a fiber bundle 3 of thermoplastic synthetic staple fibers is fed at a predetermined speed by a pair of feed rollers 4 and 4', and then, the fiber bundle 3 is subjected to a false twisting operation by means of a false twisting means 5 which is disposed downstream from the feed rollers 4 and 4' and which is a fluid jet nozzle for creating a rotational fluid jet. After the fiber bundle 3 is in contact with a heater 6 which has a convex surface and which is disposed in a detwisting region of the false twisting means, it is delivered by means of a pair of nip rollers 7 and 7' to a take-up device (not shown) where it is wound on a bobbin to form a yarn package. When the fiber bundle 3 contacts the heater 6, the surface fibers in the fiber bundle 3, which have been detwisted, wrap around the body portion of the fiber bundle 3.

Figure 4B:
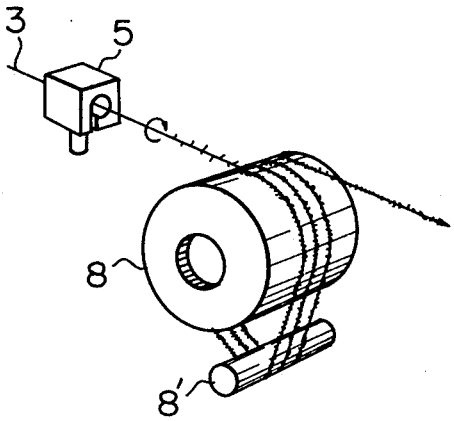
FIG. 4B is a perspective view of a part of the step illustrated in FIG. 4A.

In FIG. 4A, instead of the fixed type heater 6 in FIG. 3, a rotatable heated roller 8 is utilized. The heated roller 8 is rotated at a peripheral speed being substantially the same as the running yarn speed, and has a rotatable separate roller 8' paralleled therewith so that the fiber bundle 3 is turned therearound several times. The heater 6 in FIG. 3 can make the surface fibers wrap around the fiber bundle. The rotatable heated roller 8 in FIG. 4 can also make the surface fibers which have been detwisted wrap around the fiber bundle and be firmly set more effectively in a short time, because the rotatable heated roller is preferable to wrap surface fibers extending outwards like piles around the core fiber bundle in a short time and to heat set the wrapped surface fibers while the running fiber bundle is moving on the surface of the heated roller as illustrated in FIG. 4B. As a result, fibers in each wrapping portion are interlaced well with each other and a firm cohesion can be obtained.

As illustrated in FIGS. 10A through 10F, in the wrapping portion of the yarn of the present invention, the surface fibers wrap around the bundle not in a condition so that completely parallel with each other, but rather, in a condition so that they are interlaced each other.

The cohering mechanism of the present invention will be further described hereinbelow in detail. A superior characteristic of the spun-like yarn according to the present invention is that the surface fibers form wrapping portions which are substantially perpendicular to the yarn axis and which are independent from each other. Accordingly, because of the above-mentioned characteristic, the spun-like yarn of the present invention is distinguished from that of the conventionally known type. The inventors of the present invention confirmed that the distinguished wrapping structure of the present invention could be obtained by the heat treatment of a fiber bundle essentially comprising staple fibers in a detwisting region located downstream from the false twisting means, in other words, by heat treating the yarn bundle while imparting the twisting torque along the bundle being at least partially prevented, so that the surface fibers in the fiber bundle are wrapped by means of the false twisting operation. In comparison with the present invention, when a yarn which is being false twisted and which locates upstream from the false twisting means is heat set, such wrapping structure as that of the present invention cannot be obtained. In the latter case, the structure of the yarn which has been temporarily set is again subjected to a detwisting operation wherein the set structure is destroyed, and accordingly, it cannot be expected that a stable perpendicular wrapping is created on a fiber bundle. On the other hand, only when the staple fibers are subjected to heat treatment in a detwisting region where the false twisted fibers are finally transferred to be stable, perpendicular wrappings which are independent from each other can be obtained, and the density of the wrappings along the obtained yarn is high. This is the reason why the fiber bundle is heat treated in the detwisting region in the present invention.

The spun-like yarn thus obtained according to the present invention has a mean fiber packing density between 2 cubic centimeters per one gram and 8 cubic centimeters per one gram.

The mean fiber packing density of the spun-like yarn according to the present invention is different from that of a conventional spun-like yarn, for example, that disclosed in the above-mentioned Japanese Patent Publication No. 28250/68 or Japanese Patent Laid-open No. 89650/75, wherein the fiber packing density is considered to be less than 2 cubic centimeter per one gram. The spun-like yarn of the present invention has a slightly larger packing density, however, it also has both a high yarn strength and an ability for maintaining stable configuration of the yarn. If the fiber bundle is false twisted but is not heat set during wrapping by means of a heater in a detwisting region, a very bulky yarn having a mean fiber packing density larger than 8 $cm^3/g$ is obtained; however, such a yarn has disadvantages in that the yarn strength is low and the configuration of the yarn is fragile.

Figure 5:
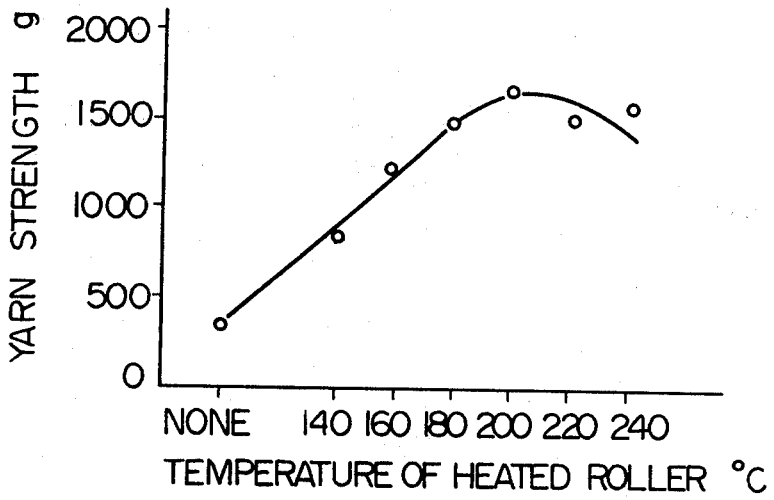
FIG. 5 is a diagram wherein the relationship between the temperature of the heated roller and the yarn strength is illustrated.

FIG. 5 is a diagram which illustrates the relationship between the temperature of heater (heated roller) and the yarn strength. Yarn strength in grams is plotted on the ordinate and temperature of the heated roller, in °C. is plotted on the abscissa. More specifically, the rotatable heated roller 8 in FIG. 4 is used as a heater, and a fiber bundle of a polyester, the yarn count of which is ten, was spun at a speed of 400 m/min. As is apparent from FIG. 5, the strength of the obtained yarn was increased as the temperature of the rotatable heated roller was increased, and there was a peak of the yarn strength around the temperature between 200° C. and 240° C. When the heated roller is not used, and if the spinning speed is increased, it has been observed that the yarn strength is rapidly decreased, and as a result, the obtained spun-like yarn cannot be actually used. On the other hand, in the embodiment of the present invention, a heated roller is used, and when the spinnig speed is increased, if the temperature of the heated roller is also increased, the strength of the yarn will not be decreased.

Figure 6:
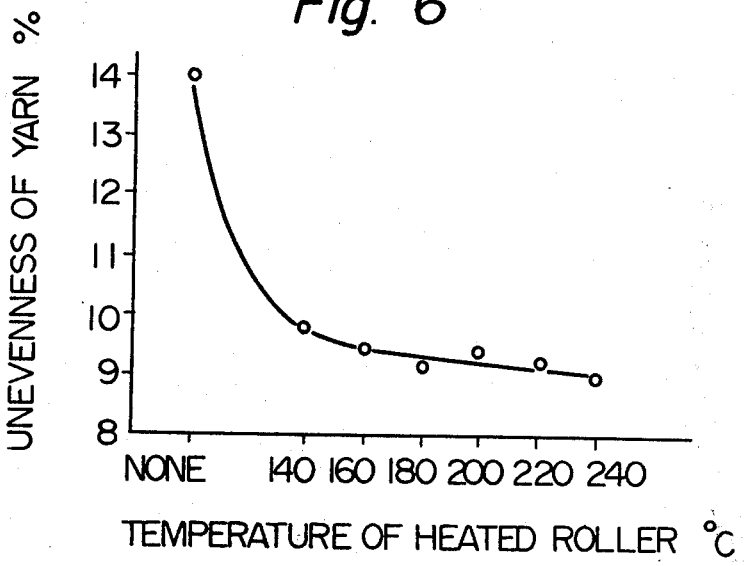
FIG. 6 is a diagram wherein the relationship between the temperature of the heated roller and the uniformity of the yarn is illustrated.

The spun-like yarn of the present invention has a stable and required strength, and therefore, when the yarn is used in a treatment for two ply yarns or in a weaving or knitting operation, the operational troubles, such as the decrease of the operational efficiency caused by the yarn breakage, can be obviated. In addition, in the spun-like yarn of the present invention the wrapping portions, wherein the surface fibers firmly wrap around the fiber bundle constituting the core in a direction substantially perpendicular to the fiber bundle, are independent from each other. Accordingly, if the surface fibers are partially broken, the cohesion of the fiber bundle created by the wrapping of the surface fibers is not affected. Please note that in a conventional spun-like yarn, since surface fibers helically and continuously wrap around the fiber bundle, the cohesion of the fiber bundle lapses and the configuration of the yarn is destroyed when a part of the wrapped surface fiber is broken. Accordingly, the spun-like yarn of the present invention is free from the disadvantages which are mentioned above, and it has a stability in its configuration. Furthermore, it is obvious from FIG. 6, that as the temperature of the heated roller is increased, the evenness in the yarn thickness is increased, because the number of the wrapping portions is increased as the temperature is increased.

As mentioned above, in the spun-like yarn of the present invention, a fiber bundle for forming the core has substantially no true twists therein and has cohesion, and the surface fibers wrap not continuously but discontinuously or independently around the fiber bundle. As a result, the fibers which are parallel to the yarn axis are exposed to the outside at almost the entire peripheral surface of the spun-like yarn except at the wrapping portions, and the woven or knitted fabric obtained from the spun-like yarn has a soft touch. Because the surface fibers are independently wrapped, the adjacent fiber bundle of the spun-like yarn of the present invention can become closer than a conventional spun-like yarn, and the gap between the adjacent yarns becomes small when the yarns are used in a woven or knitted fabric. Particularly, if the spun-like yarn of the present invention is utilized in a woven fabric, the gaps formed by the crossing of the warp and weft can be decreased, and therefore, the spun-like yarn is preferable for use in cloth, such as sailcloth or curtain fabric, which requires a low air permeability and an ability for shielding light.

Furthermore, since the spun-like yarn of the present invention has a mean fiber packing density of between 2 $cm^3/g$ and 8 $cm^3/g$, and since the fiber bundle constituting the core has substantially no twist therein, the woven fabric resulted from the spun-like yarn has a soft hand, even when it has small gaps therein. In a conventional manner, if it is desired to obtain such a woven fabric, it is necessary that the set of warps and wefts be large. On the other hand, when the spun-like yarn of the present invention is utilized, it is unnecessary that the set of warps and wefts be large. In a case wherein the set of warps and wefts are large, since the spun-like yarn per se has a tendency to make the woven fabric obtained therefrom have a soft hand because of its mean fiber packing density and substantially no twist therein, such woven fabric that has a soft hand can be obtained.

The mean fiber packing density described in the present specification is measured in accordance with the following method. Apparent diameter d is measured by means of an ocular microscope at 20 points on a test piece one meter long, and then, an arithmetic mean $\bar{d}$ of the apparent diameter is calculated from the obtained data. The apparent volume V in $cm^3$ per one meter is calculated based on the obtained arithmetic mean $\bar{d}$. On the other hand weight M in grams of the yarn having a one meter length is measured. The mean fiber packing density in $cm^3/g$ is calculated as $V \div M$ by utilizing the obtained apparent density V and the measured weight of the yarn M.

The number of the wrapping portions is counted on a test piece one meter long, and then, the number of the wrapping portions per one centimeter is calculated based on the obtained member.

An example of the present invention will now be explained.

Figure 7A:
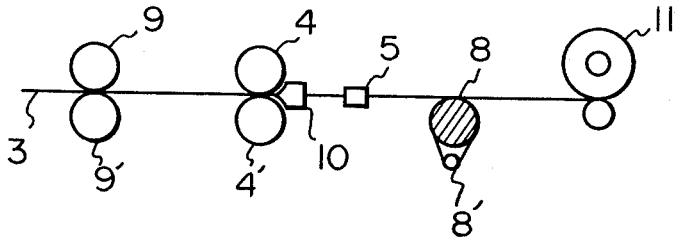
FIGS. 7A and 7B are elevational and plan views which illustrate a process of an embodiment according to the present invention.
Figure 7B:
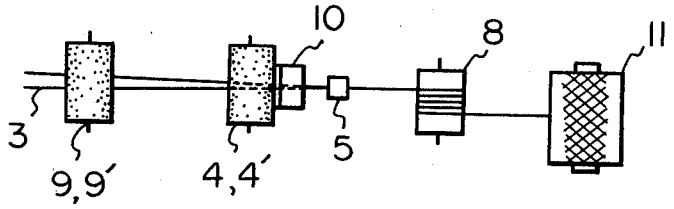

In FIGS. 7A and 7B, a polyester tow 3 having a total denier of 5000 de composed of a plurality of continuous polyethylene terephthalate filaments having a thickness of 1.5 denier is fed by means of a pair of feed rollers 9 and 9' to a pair of draft rollers 4 and 4'. The peripheral speed of the draft rollers 4 and 4' is higher than that of the feed rollers 9 and 9' so that the supplied polyester tow 3 is drafted under a draft ratio between 20 and 100 and is stretch-broken, and a staple fiber bundle having a total denier between 250 and 500 denier and a mean fiber length of 300 mm is obtained. The staple fiber bundle is fed through an aspirator 10 into a fluid jet nozzle 5 for imparting false twists where the staple fiber bundle is subjected to a false twisting operation. If the staple fiber bundle, just before it is subjected to the false twisting operation, was widely spread out, a cohesive spun-like yarn wherein surface fibers are continuously and helically wrapped around the core fiber bundle would be obtained as described in Japanese Patent Publication No. 28250/68. However, when such a tow having a small total denier is drafted and broken, the tow is spread out at most four or five millimeters. Such a width of the tow is not sufficient to create various twisting angles in the wrapping surface fibers, and therefore, the obtained yarn does not have sufficient cohesion. Note that the spread width of 7.5 mm (0.3 inch) described in Japanese Patent Publication No. 28250/68 is satisfactory only for a thin yarn having a total denier of up to 30 or 50 denier and that, if a yarn having a total denier between 250 and 500 denier, it is necessary that the yarn should be spread out to a width of 30 or 40 mm. If the tow is not spread out to such a width, an efficient cohesion cannot be expected. If such a widely spread fiber bundle is required, it has been proposed that a thick silver be drafted while it is widely spread or that a tow be divided into a plurality of sub-tows and the sub-tows are fed in parallel as illustrated in FIGS. 1 and 2, of Japanese Patent Publication No. 28250/68. However, when a tow which has been drafted and broken is utilized as illustrated in the present embodiment, because of the above reasons, it is very difficult to obtain a widely spread fiber bundle. On the other hand, it is generally said that to obtain a yarn having a low unevenness in thickness the draft ratio should be low, and therefore, in turn it is preferable that the total denier of the feed tow is low. As a result, it is very difficult to obtain a widely spread out fiber bundle which has been drafted and broken.

Figure 8:
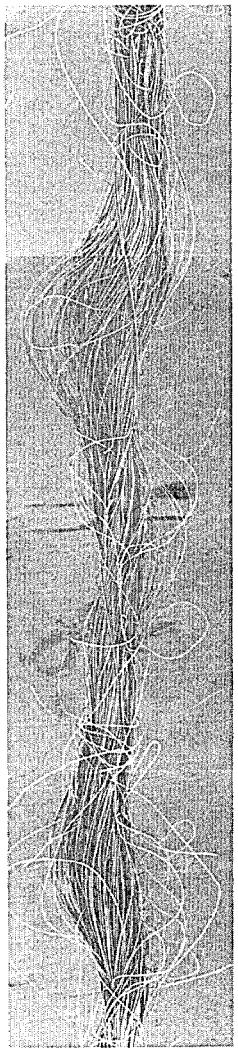
FIG. 8 is a photomicrograph of a conventional wrapped spun-like yarn.

FIG. 8 is a photomicrograph of a spun-like yarn having a total denier of 500 denier which was obtained by spreading the drafted and broken fiber bundle to a width of 5 mm and by imparting false twists thereto at a speed of 500 m/min by means of a fluid jet nozzle supplied with compressed air, the pressure of which is 4 $kg/cm^2$. A continuous spun-like yarn was obtained, however, the cohesion thereof was not high and may be lost easily. Accordingly, the yarn could not be used for an actual woven fabric. The mean number of the wrapping portions was less than 1/cm, and the fiber packing density was more than 10 $cm^3/g$.

Figure 9:
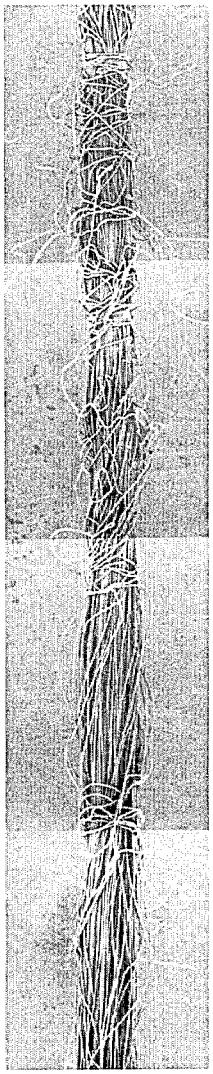
FIG. 9 is a photomicrograph of a yarn according to the present invention.
Figure 10A:
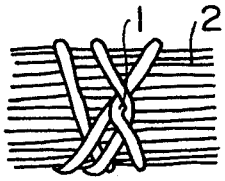
FIGS. 10A through 10F are plan views of wrapping portions according to the present invention.
Figure 10B:
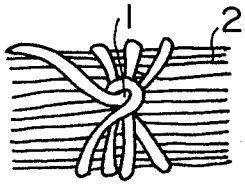
Figure 10C:
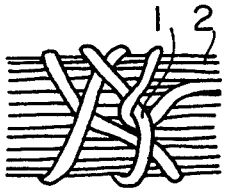
Figure 10D:
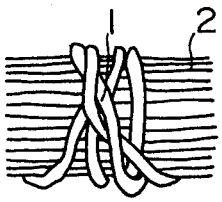
Figure 10E:
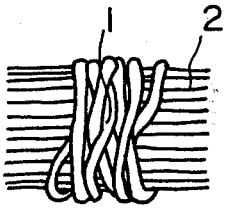
Figure 10F:
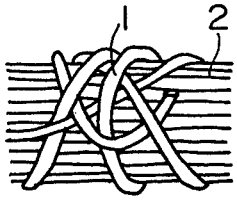

On the other hand, as illustrated in FIG. 7A, when the fiber bundle delivered at a speed of 500 m/min and spread in a narrow width was wound several turns around a hot roller 8 heated at a temperature of 220° C. and a separate roller 8' disposed in parallel with the heated roller 8 in accordance with the present invention so that surface fibers were wrapped around the fiber bundle and heat set, a useful spun-like yarn was obtained. A photomicrograph of the obtained spun-like yarn is illustrated in FIG. 9. As illustrated in FIG. 9, it is obvious that the number of the wrapping portions is larger than that of conventional spun-like yarn illustrated in FIG. 8 and that the fiber bundle is firmly wrapped by surface fibers, and as a result, the obtained spun-like yarn has almost as high an ability to be woven as that of the usual spun yarn. The mean number of the wrapping portions was 4/cm, and the fiber packing density of the yarn was 5 cm/g.

According to the present invention, while a tow having a small total denier is supplied without effecting any special design or attempt to spread it widely, a spun-like yarn which is almost as good as the usual spun yarn in ability to be treated in a weaving or knitting process can be obtained through one process at a high speed. Accordingly, the process of the present invention is superior to a conventional process. In addition, the present invention has another advantage in that a thick fiber bundle which has too large a total denier to cohere according to a conventional process can be cohered in accordance with the present invention.

What we claim is:

1. A spun-like yarn comprising; a fiber bundle which essentially comprises staple fibers and which substantially has no true twist therein along said yarn; and surface fibers of thermoplastic synthetic staple fibers which wrap around said fiber bundle so that said fiber bundle is cohered, wherein said surface fibers form a plurality of individual wrapping portions spaced along said yarn, each of said wrapping portions being securely wrapped around said fiber bundle in a direction substantially perpendicular to said fiber bundle, and in each of said wrapping portions said surface fibers are interlaced with each other, the number of said wrapping portions being at least 2 per the length of 1 cm of said yarn, and the mean fiber packing density of said yarn being in a range between 2 $cm^3/g$ and 8 $cm^3/g$.

2. A spun-like yarn according to claim 1, wherein said staple fibers composing said fiber bundle are made of a polyester.

3. A spun-like yarn according to claim 1, wherein said staple fibers composing said surface fibers are made of a polyester.

4. A spun-like yarn according to claim 1, wherein said staple fibers composing said fiber bundle and said surface fibers are made of a polyester.

5. A process for manufacturing a spun-like yarn comprising a fiber bundle and surface bundles, which process comprises:

a step of delivering a fiber bundle essentially comprising thermoplastic synthetic staple fibers;

a step of imparting false twists to said delivered fiber bundle in a false twisting region; and a step wherein, just after said fiber bundle is false twisted, said false twisted fiber bundle is detwisted and then said fiber bundle in a detwisting region located downstream of said false twisting region is heated while said fiber bundle is being delivered and the rotational movement of surface fibers generated by said detwisting is prevented so that said surface fibers of said fiber bundle wrap around the body portion of said fiber bundle in a direction perpendicular to said lengthwise direction of said fiber bundle, and so that they are heat set.

6. A process according to claim 5, wherein said false twisted fiber bundle is in contact with a heater located in said detwisting region.

7. A process according to claim 6, wherein said heater is a heated roller which is rotatable.

8. A process according to claim 6 or 7, wherein the heater is heated at a temperature between 160° C. and 250° C.

* * * * *

UNITED STATES PATENT OFFICE

CERTIFICATE OF CORRECTION

Patent No. 4,265,082 Dated May 5, 1981

Inventor(s) Yoshiyuki Sasaki, et al.

It is certified that error appears in the above-identified patent and that said Letters Patent are hereby corrected as shown below:

In the title page, following "Takatsuki" and "Ibaraki", there should be inserted in each instance, --Osaka--.

In the Abstract, lines 10-11: "stopped rotation" should be --stop rotating--.

last line: "interlaced each" should read --interlaced with each--.

Column 5, line 48: "interlaced each" should read *interlaced with each--.

Column 6, line 28: "centimeter" should read --centimeters--.

line 30: "density," should read --density;--".

UNITED STATES PATENT OFFICE

CERTIFICATE OF CORRECTION

Patent No. 4,265,082 Dated May 5, 1981

Inventor(s) Yoshiyuki Sasaki, et al.

It is certified that error appears in the above-identified patent and that said Letters Patent are hereby corrected as shown below:

Column 6, line 56: "spinnig" should read --spinning--.

Column 8, line 35: "having" should read --has--.

line 41: "silver" should read --sliver--.

Column 9, line 30: Delete ";".

Signed and Sealed this

*Twenty-sixth* Day of *January 1982*

[SEAL]

*Attest:*

GERALD J. MOSSINGHOFF

*Attesting Officer*

*Commissioner of Patents and Trademarks*